US007647986B2

(12) United States Patent
Kettner

(10) Patent No.: US 7,647,986 B2
(45) Date of Patent: Jan. 19, 2010

(54) TOOL

(75) Inventor: Konrad Karl Kettner, Aalen (DE)

(73) Assignee: Cooper Power Tools GmbH & Co., Westhausen (DE)

( * ) Notice: Subject to any disclaimer, the term of this patent is extended or adjusted under 35 U.S.C. 154(b) by 0 days.

(21) Appl. No.: 11/939,307

(22) Filed: Nov. 13, 2007

(65) Prior Publication Data

US 2008/0110656 A1 May 15, 2008

(30) Foreign Application Priority Data

Nov. 13, 2006 (EP) ..... 06023566

(51) Int. Cl.
*B25B 25/02* (2006.01)

(52) U.S. Cl. ..... 173/93.5; 173/93; 173/104; 173/218

(58) Field of Classification Search ..... 173/93, 173/93.5, 93.6, 218, 176, 104
See application file for complete search history.

(56) References Cited

U.S. PATENT DOCUMENTS

| | | | | |
|---|---|---|---|---|
| 2,727,598 | A | 12/1955 | Mitchell et al. | |
| 3,477,521 | A | 11/1969 | Kiester et al. | |
| 3,643,749 | A | 2/1972 | Pauley | |
| 3,930,764 | A | 1/1976 | Curtiss | |
| 4,359,107 | A | 11/1982 | Smith | |
| 4,418,764 | A | 12/1983 | Mizobe | |
| 4,444,272 | A | 4/1984 | Karden et al. | |
| 4,683,961 | A * | 8/1987 | Schoeps | 173/93 |
| 4,836,296 | A | 6/1989 | Biek | |
| 4,920,836 | A * | 5/1990 | Sugimoto et al. | 81/463 |
| 4,967,852 | A * | 11/1990 | Tatsuno | 173/93 |
| 5,080,181 | A * | 1/1992 | Tatsuno | 173/93.5 |
| 5,092,410 | A | 3/1992 | Wallace et al. | |
| 5,172,772 | A * | 12/1992 | Kettner et al. | 173/93 |
| 5,217,079 | A * | 6/1993 | Kettner et al. | 173/177 |
| 5,492,185 | A | 2/1996 | Schoeps et al. | |
| 5,544,710 | A | 8/1996 | Groshans et al. | |
| 5,573,074 | A | 11/1996 | Thames et al. | |
| 5,611,404 | A | 3/1997 | Biek et al. | |
| 5,735,354 | A * | 4/1998 | Weidner et al. | 173/93.5 |
| 5,775,439 | A * | 7/1998 | Biek | 173/1 |
| 5,813,478 | A * | 9/1998 | Kettner | 173/93 |
| 6,059,049 | A | 5/2000 | Lin | |
| 6,110,045 | A * | 8/2000 | Schoeps | 464/25 |
| 6,179,063 | B1 * | 1/2001 | Borries et al. | 173/93.5 |
| 6,217,306 | B1 | 4/2001 | Seward et al. | |
| 6,241,500 | B1 | 6/2001 | Ellis | |
| 6,334,494 | B1 * | 1/2002 | Nagato | 173/93.5 |
| 6,505,690 | B2 * | 1/2003 | Tokunaga | 173/93.5 |

(Continued)

FOREIGN PATENT DOCUMENTS

DE 20210453 U1 11/2003

(Continued)

*Primary Examiner*—Scott A. Smith
(74) *Attorney, Agent, or Firm*—King & Spalding LLP

(57) ABSTRACT

The invention relates to a tool (1), in particular an impact wrench, with a pulse unit (6) having a hydraulic impact mechanism (7) and a drive unit (24). The working volume (5) can be connected within the hydraulic impact mechanism (7) to an additional volume (4) formed outside of the mechanism. The tool according to the invention is characterised in that at least the compensating volume (4) can be varied independently of the pressure.

22 Claims, 2 Drawing Sheets

U.S. PATENT DOCUMENTS

| | | | | |
|---|---|---|---|---|
| 6,527,060 | B1 * | 3/2003 | Schoeps | 173/93.5 |
| 6,708,778 | B2 * | 3/2004 | Tokunaga | 173/93.5 |
| 6,796,386 | B2 | 9/2004 | Izumisawa et al. | |
| 6,863,134 | B2 | 3/2005 | Seith et al. | |
| 6,883,617 | B2 | 4/2005 | Putney et al. | |
| 6,902,011 | B2 * | 6/2005 | Hall | 173/169 |
| 6,988,565 | B2 * | 1/2006 | Giardino | 173/176 |
| 7,032,685 | B2 * | 4/2006 | Nakamizo | 173/93.5 |
| 7,237,622 | B2 * | 7/2007 | Liao | 173/104 |
| 2008/0110655 | A1 | 5/2008 | Kettner | |

FOREIGN PATENT DOCUMENTS

| | | | |
|---|---|---|---|
| EP | 0292752 | A2 | 11/1988 |
| EP | 0309625 | A1 | 4/1989 |
| EP | 0885693 | A2 | 12/1998 |

* cited by examiner

TOOL

FIELD OF THE INVENTION

The invention relates to a tool and in particular an impact wrench, with a hydraulic impact mechanism and a driver unit, wherein a working volume within the hydraulic impact mechanism can be connected to an additional volume formed outside of the said mechanism.

BACKGROUND OF THE INVENTION

A tool of this nature is known from DE 202 10 453 U1 (Cooper), wherein the working volume within the hydraulic impact mechanism is connected to an additional volume within the hydraulic cylinder through a small hole, which is closed during the pulse by a plate. A cover sealed with O-ring seals closes the hydraulic cylinder and thus defines the complete working volume of the pulse unit, because it is not adjustable for the setting of different working volumes. A spacer ring presses the cover against the cylinder wall and a locking ring permanently fixes the cover. Due to the defined mounting position of the locking ring, the distance between the hydraulic cylinder and the cover and thus also the working volume is defined and cannot be changed. The space for the working fluid cannot be adjusted and the required amount of the working fluid can only be provided by the addition or removal via a filling opening. Conventionally, the chamber is first completely filled with working fluid and then the removal occurs with syringes, which draw the fluid out of the inner space until a desired volume is obtained. This filling procedure is very cost-intensive and imprecise. Furthermore, it is not possible to change the working volume.

From the document DE 40 18 084 C1 a pulse nutsetter is known, the hydraulic impact mechanism of which is closed off on one side with a hydraulic impact mechanism cover, which is fixed, secured against turning, by means of a positioning pin. A cover plate then closes off the complete assembly. In this hydraulic impact mechanism the working volume remains constant.

From DE 698 07 013 T2 a tool is known, which has an impact wrench with a motor which rotates a drive element within a fluid chamber, wherein the drive element is fitted with a common fluid chamber with a variable volume. With an expansion of the hydraulic fluid the common chamber accepts the additional fluid volume. With the decrease in the expansion the common chamber passes the fluid back into the fluid chamber. The compensation is handled by an elastically deformable membrane which consists of two areas. The first area is connected to the fluid chamber via a channel and the second membrane layer is intended to provide protection against destruction due to the chemically aggressive hydraulic fluid. The increase in volume within the common fluid chamber leads to a deformation of the membrane and thus to enlargement of the working volume. When the temperature of the hydraulic fluid decreases, the excess fluid, which previously passed into the common chamber, returns via the channel into the common chamber and the membrane is relieved. The working volume can thus only be changed depending on the pressure of the working fluid. A specific volume setting is not possible.

Accordingly, the object of the invention is to improve a tool of the type mentioned in the introduction such that the working volume can be set within the hydraulic impact mechanism irrespective of the consistency of the working fluid and at any time.

SUMMARY

This object is solved according to the invention in that the additional volume connected to the working volume can be varied independently of the pressure.

According to the invention a tool is provided with a hydraulic impact mechanism with a working volume and an additional volume formed outside of this hydraulic impact mechanism, wherein at least the additional volume can be varied such that it is not dependent on the consistency of the working fluid and not on the pressure relationships within the hydraulic impact mechanism. On the contrary, the setting of the additional volume occurs independently of the surrounding conditions. Thus, a change of the additional volume can also be realised when the pressure relationships have not changed due to the working processes within the pulse unit. Similarly a change in the compensating volume can take place when the volume of the working fluid changes. And furthermore an adjustment to the additional volume can be made, although the volume of the working fluid has changed.

A particularly advantageous further development of the invention provides for the hydraulic impact mechanism to be arranged between the drive unit and a tool holder in order to ensure a force transfer with the least possible losses. Furthermore, the size of the tool can be particularly advantageously designed due to this arrangement.

In an advantageous embodiment of the invention the hydraulic impact mechanism can have a single-ended limiting setting means. In this way the hydraulic impact mechanism is closed at least on one end by a means which can be set or adjusted.

In a particularly advantageous embodiment of the invention the additional volume can be enlarged and/or reduced with the setting means. Thus the user's precise volume requirements for the reserve oil, oil compensation and pulse frequency change can be set to a demanded quantity in a time-saving manner.

Advantageously, the setting means can be a manually adjustable piston. This embodiment ensures a quick change of the additional volume within the hydraulic impact mechanism. The adjustable piston has a surface which is particularly advantageous for manual actuation, which prevents slippage of the fingers or hand due to its rough finish. This can be realised, for example, by knurling or with an additionally applied, easily grasped surface coating or other suitable means.

In a further embodiment of the invention the piston can be adjusted via an external and/or internal thread relative to the hydraulic cylinder. The adjustment method using a thread here offers a particularly precise way of setting the translational travel and thus the change of volume within the hydraulic impact mechanism. The use of an external and/or internal thread here increases the possible applications and adapts the piston to different installation conditions. In a preferred embodiment the thread is a fine thread with which even the smallest of changes in volume can be realised due to the low pitch of the thread.

In an advantageous embodiment of the invention the additional volume can be arranged between the hydraulic cylinder and the piston. This construction ensures the direct influence on the volume when the hydraulic cylinder or the piston is adjusted.

Advantageously, the piston can be adjusted relative to the tool via a thread for the change of volume. Thus a fine adjustment of the piston can occur and also precise volume changes can be realised in small steps.

In an advantageous embodiment of the invention the piston can be manufactured from resilient, stiff and low-mass material. In particular hard anodised aluminium offers favourable properties for the application of the piston in pressurised surroundings, wetted with oil. Also externally acting stresses can be very well absorbed by a piston manufactured from coated aluminium.

In an advantageous embodiment of the invention the piston can be sealed relative to the hydraulic cylinder with O-ring seals. In particular in pressurised surroundings, wetted with oil, these seals offer good sealing of the piston. Also other suitable seals can be used.

In a particularly advantageous embodiment of the invention the piston can be fixed in at least one rotary position. In this way, the piston can be fixed once it has reached the desired set position. An unwanted movement when using the tool is thus prevented.

In an advantageous embodiment of the invention the hydraulic cylinder can have at least four fixable rotary positions, each arranged offset by 90°. Through the arrangement with at least four rotary positions, an adequate, flexible fixing method is provided.

Alternatively, more grooves on the piston are also possible; an odd number compared to the number of grooves on the hydraulic cylinder is advantageous, e.g. 3 to 4 produces 12 possible positions per rotation of the piston.

In a further embodiment of the invention the piston can be bound fixed to the hydraulic cylinder in at least one rotary position. In this way secure positioning of the piston during the use of the tool can be ensured.

Advantageously the piston can be fixed to the hydraulic cylinder in at least one rotary position by means of a locking element. Here, the locking element provides a particularly reliable protection against rotation.

In a variant of the invention the locking element can be a pin, sleeve or threaded stud. Due to its high shearing strength as well as the simple and quick assembly, this represents a good method of fixing.

In a further embodiment of the invention the piston can be rotated many times using an auxiliary tool for the change of volume. The tool can transfer the force needed for the rotation particularly easily to the piston. In addition a tool can be employed even in assembly situations where access is difficult.

In a variant of the invention the piston can have an essentially L-shaped profile. In this way the piston weight can be reduced and a smaller design realised.

In a favourable embodiment of the invention the piston can have an outer limb, which forms a chamber for reserve oil with the outer surface of the hydraulic cylinder. Thus the chamber for the reserve oil can be formed with just a few components. The complete assembly can through this compact arrangement be realised in a particularly small size.

Advantageously, the piston can have an internal thread which essentially corresponds to the external thread of the hydraulic cylinder. In this way a perfect and non-jamming connection of the piston to the hydraulic cylinder can be ensured.

In an advantageous embodiment of the invention the piston can have two cylindrical internal diameters of differing size. In this way the piston can be adapted to the shape of the hydraulic cylinder and represents a particularly space-saving installation variant.

In an advantageous embodiment of the invention at least one of the internal diameters of the piston can have a groove for an O-ring seal. Due to the positioning of the O-ring seal within the piston, it can be particularly well sealed.

In a variant of the invention at least one of the internal diameters of the piston can have a mounting surface for an O-ring seal. In this way an installed O-ring seal can make a particularly good contact with the internal diameter and seal the system.

In a particularly advantageous embodiment of the invention the piston can have at least one receptacle opening for the locking element. The locking element can thus be positioned securely and the piston protected against rotation.

In a favourable embodiment of the invention the piston can be preset at the factory to a predefined number of pulses, which for example may be 10 to 40 Hz. In this way the user of the tool can adapt the pulse frequency range to his own requirements.

In a particularly advantageous embodiment of the invention the piston can be fixed relative to the hydraulic cylinder with the locking element after the pulse rate has been set. In this way the preset pulse rate of preferably 30 Hz can be securely fixed and protected against unwanted adjustment.

BRIEF DESCRIPTION OF THE DRAWINGS

A preferred embodiment of the invention will now be described based on the enclosed drawings. The following are shown.

In the drawings identical components are designated with the same reference numerals throughout.

DETAILED DESCRIPTION OF THE EXEMPLARY EMBODIMENTS

Figure 1:
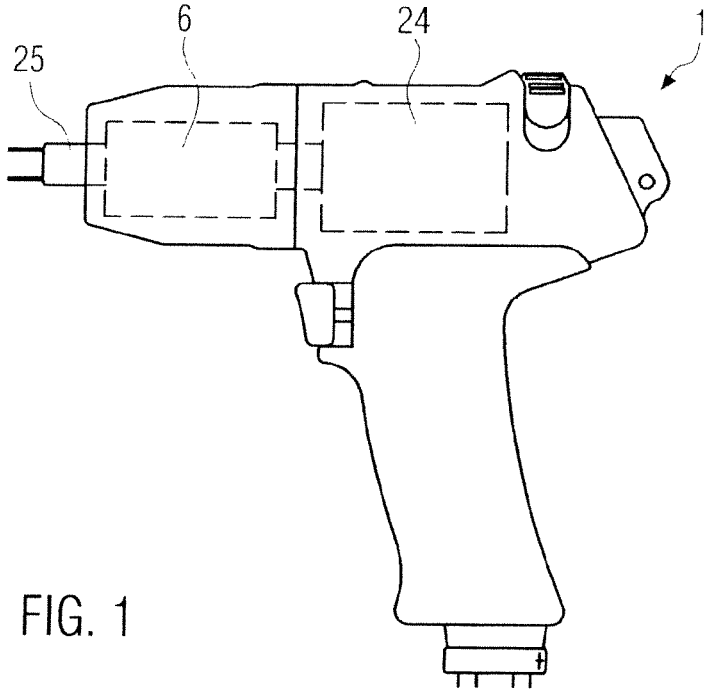
FIG. 1 a schematic illustration of a tool according to the invention.
Figure 3:
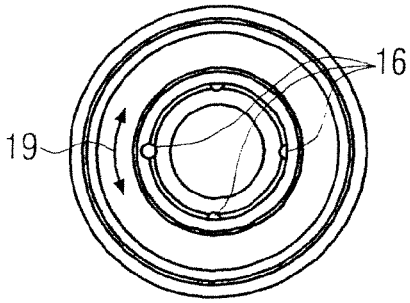
FIG. 3 a side view of the hydraulic impact mechanism illustrated in FIG. 2, FIG. 4 a functional illustration of the hydraulic impact mechanism with a preset additional volume for the reserve oil prior to the actual filling with oil, FIG. 5 a functional illustration of the hydraulic impact mechanism with an enlarged additional volume for accepting the expansion oil after filling and closure of the hydraulic impact mechanism, FIG. 6 a functional illustration of the tool with a further additional volume for increasing the pulse frequency. The pulse frequency increases because, due to the larger volume compared to the oil filling, the pulse phase sets in later and the acceleration phase thus starts earlier.

FIG. 1 illustrates a schematic side view of a tool 1, which has a drive unit 24, a hydraulic impact mechanism 7 connected to it and a final drive. The drive unit 24 is a conventional motor with a compressed air feed. The pressure can be individually switched on by the user via a valve.

The hydraulic impact mechanism essentially consists of a hydraulic rotor 26, a hydraulic cylinder 11 and hydraulic vanes 23, which together are driven by a compressed air motor as the drive unit 24. The hydraulic rotor 26 with the tool holder 25 is rotated by the movement of the pressure medium, for example hydraulic oil, located in a pulse chamber 18 of the hydraulic cylinder. In this way a screw or a nut is screwed into a component. The hydraulic rotor 26 and the hydraulic cylinder 11 continue to be driven by the drive unit 24 as long as the screw head or the nut is not screwed down. However, once the screw head or the nut is seated, the hydraulic rotor 26 experiences a counter force. To tighten the screw or nut it is now necessary to continue to apply a torque to the screw with the hydraulic rotor 26. During the screwing process the space, eccentric to the hydraulic rotor 26, in the cylinder housing 11 causes varying pressure relationships on the hydraulic rotor 26 and a higher compression in the constrained housing space 11. The pulse unit 6 has a hydraulic impact mechanism 7 which has four sealing areas on the hydraulic cylinder 11 and four vanes 23 on the hydraulic rotor 26. During a pulse phase the vanes 23 mounted in the cylinder 11 seal the four spaces created in the pulse chamber 18 at the web-shaped sealing areas 9 of the hydraulic cylinder 11. In each case two oppositely situated spaces are high pressure chambers and the other two oppositely situated spaces are low pressure chambers. The ensuing pressure acts on the vanes 23 and produces a hydraulic pulse, which occurs in a rapid succession one after the other due to the motor rotation and corresponds to the impacts of a mechanical impact wrench. After delivering the pulse, the drive unit 24 must accelerate the hydraulic cylinder 11 again over a complete rotation for the next pulse. In order that the pulses quickly follow one another, a short travel time over the sealing areas 9 is required after the last pulse has been realised.

Figure 2:
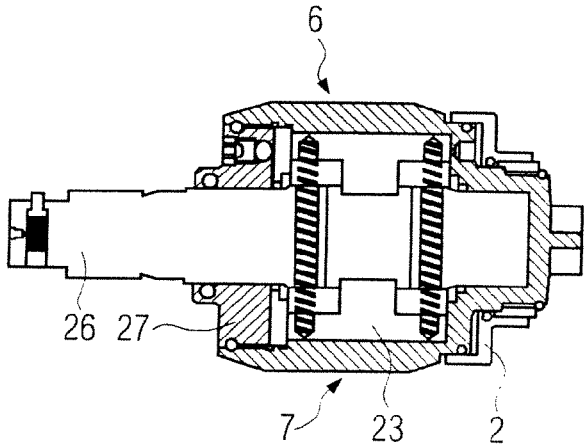
FIG. 2 a sectional view of the hydraulic impact mechanism.

A connection to the additional volume is sealed during the pulse phase by a vane, refer to FIG. 2.

For simplification a screw attachment, for example, for the tool holder or the compressed air feed is not illustrated.

FIG. 2 illustrates a sectional view of the hydraulic impact mechanism 7 with a drive spindle 26, which extends starting from the drive unit 24 through the hydraulic impact mechanism 7. The tool required for the job in hand is inserted at the free end of the drive spindle 26 protruding from the tool. The end covering of the hydraulic impact mechanism 7 is provided on the output end of the hydraulic rotor 26 by a bearing cap 27 which has a filling opening for the hydraulic oil. The other end of the hydraulic impact mechanism 7 is closed off with a rotating piston 2. The assembly of the pulse unit 6 before introducing it into the screwdriver 1 takes place as follows. The hydraulic impact mechanism 7, which is already fitted together, is closed off at one end with the bearing cap 27 and at the other end with the rotating piston 2 and the O-ring seals 13, 14 which are in connection with it. Before filling the pulse unit 6 with the working fluid, the rotating piston 2 is screwed onto the hydraulic cylinder 11 so far until it reaches the end-stop position. If the piston is rotated in the anticlockwise direction before filling, for example by one turn, then also working fluid is filled during the filling of this additional volume and is available later as required as a usable reserve fluid. Then the working fluid, in particular hydraulic oil, can be introduced through the filling opening into the pulse unit 6. When the working volume within the pulse unit 6 has been completely filled with hydraulic oil, the filling opening in the bearing cap 27 is tightly closed. Now there is no air within the pulse unit 6.

The rotating piston 2, which is still located in the reserve position (FIG. 4) with the hydraulic cylinder 11, can now be rotated and thus pushed axially on the hydraulic cylinder 11 such that a chamber 3 with a corresponding additional volume 4 is formed between the end faces of the piston 2 and the hydraulic cylinder 11. The size of the chamber can within limits be enlarged and reduced by rotating the piston 2. In this case the additional volume approaches zero when the piston comes up against the end face of the hydraulic cylinder 11 and it reaches its maximum volume when it is axially displaced so far from the end face of the hydraulic cylinder 11 that the last possible sealing position is reached. This sealing position is defined by the O-ring seal 13 on the outer circumference of the hydraulic cylinder 11. Advantageously a limit stop limits the possible axial travel.

Figure 5:
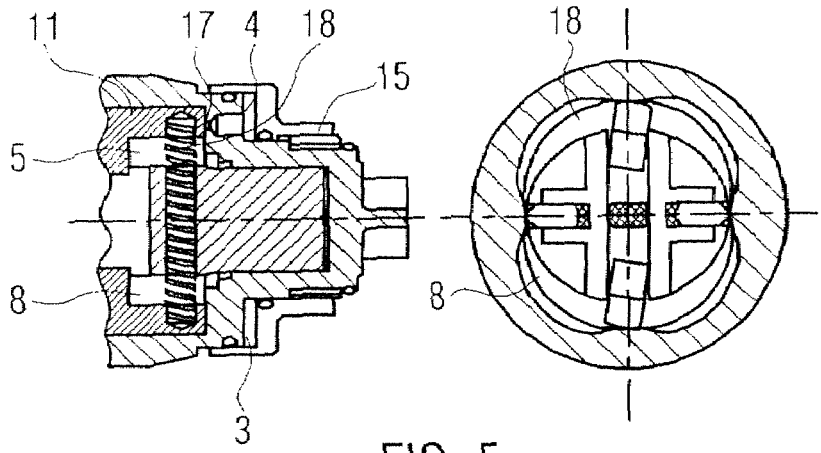
Figure 6:
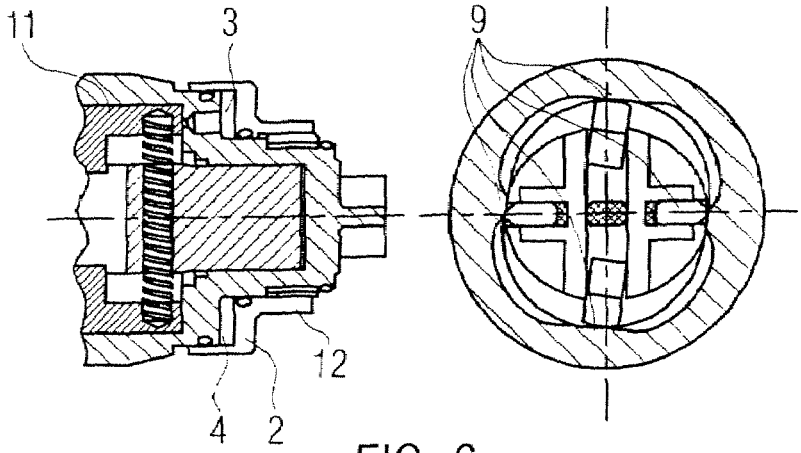

During operation of the tool the working fluid heats up within the hydraulic impact mechanism 7 and expands. If the additional volume available is not large enough, the pulse unit remains stationary if necessary until the working fluid has cooled down and the complete working fluid has reduced. With the rotating piston 2 the required additional volume is made available. To achieve this, the piston is rotated in the anticlockwise direction and the space between the end faces of the piston 2 and of the hydraulic cylinder 11 is enlarged due to the axial displacement. As can be seen in FIG. 5, the fluid compensating volume can thus be adjusted.

Figure 4:
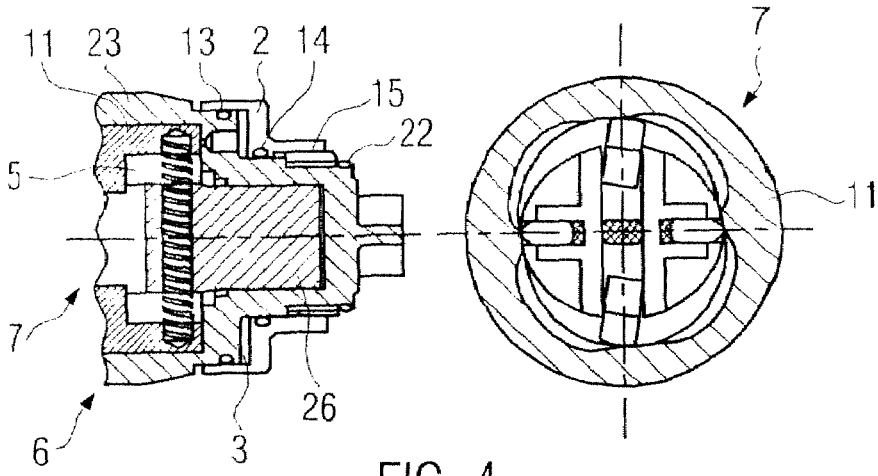

If the working fluid is fed into the hydraulic impact mechanism 7 when the rotating piston 2 is located in the position illustrated in FIG. 4, a volume of the working fluid (reserve fluid), which is enlarged by the size of the chamber 3, can be filled.

The tool can be filled with working fluid at the factory such that it reaches a pulse frequency of approximately 30 Hz. When using the tool, the reduction of the pulse frequency due to the heating of the working fluid can be counteracted in that the rotating piston 2 is rotated anticlockwise and the additional volume 4 is thus enlarged. In order that the rotating piston 2 does not rotate on its own account as work progresses, a locking element 15, which is in particular a pin, sleeve or threaded stud, is inserted between the hydraulic cylinder 11 and the rotating piston 2 to secure it axially. In this way both parts are locked together. A further O-ring seal can provide additional axial security for the inserted locking element.

The adjustment of the rotating piston 2 to enlarge the additional volume 5 and in this way to increase the pulse frequency can be carried out as often as required until the additional volume is either too large and the working fluid therefore does not provide sufficient pressure for the build-up of pulses or however the rotating piston reaches its limits due to its dimensions.

If the additional volume 5 is to be reduced, because the working fluid has been used up and to restore the pressure within the pulse chamber or to reduce the pulse frequency, the reserve oil must be activated and the piston 2 rotated in the clockwise direction so that it moves axially on the hydraulic cylinder 11. To do this the elastic ring 22 and the locking element 15 of the piston must be first removed and both are replaced after termination of the adjustment.

The axial rotational locking of the rotating piston 2 can also be realised with other axially or radially arranged fixing means, for example using a split pin.

Furthermore, the axial displacement of the rotating piston 2 is also possible through other suitable measures, such as for example a splined-shaft joint. For sealing, other sliding seals can also be used instead of O-ring seals.

The invention claimed is:

1. Tool (1), in particular an impact wrench, with a pulse unit (6) having a hydraulic impact mechanism (7) and a drive unit (24), wherein a working volume (5) within the hydraulic impact mechanism (7) can be connected to an additional volume (4) formed outside of the hydraulic impact mechanism, wherein the additional volume (4) has setting means (2) comprising a manually adjustable piston (2) that limits one end of the additional volume (4)

characterised in that, at least the additional volume (4) can be varied independently of a pressure of a working fluid.

2. Tool (1) according to claim 1, characterised in that the hydraulic impact mechanism (7) is arranged between the drive unit (24) and a tool holder (25).

3. Tool (1) according to claim 1, characterised in that the additional volume (4) can be enlarged and reduced by the setting means (2).

4. Tool (1) according to claim 1, characterised in that the piston (2) can be set via an external and/or internal thread relative to the hydraulic cylinder (11).

5. Tool (1) according to claim 4, characterised in that the hydraulic cylinder (11) has at least four fixable rotary positions (16) which are arranged offset, in particular by 90°.

6. Tool (1) according to claim 4, characterised in that the piston (2) has an internal thread, which can be screwed onto an external thread of the hydraulic cylinder (11).

7. Tool (1) according to claim 1, characterised in that the additional volume (4) is arranged between the hydraulic cylinder (11) and the piston (2).

8. Tool (1) according to claim 7, characterised in that the piston (2) has an outer limb profile which forms a chamber (3) and (4) with the hydraulic cylinder (11) for reserve oil and compensating oil.

9. Tool (1) according to claim 1, characterised in that the piston (2) is manufactured from a resilient, stiff and low-mass material, in particular hard anodised aluminium.

10. Tool (1) according to claim 1, characterised in that the piston (2) is sealed relative to the hydraulic cylinder (11) with O-ring seals (13, 14).

11. Tool (1) according to claim 1, characterised in that the piston (2) can be fixed in at least one rotary position (16).

12. Tool (1) according to claim 11, characterised in that the piston (2) is fixed in at least one rotary position (16) relative to the hydraulic cylinder (11).

13. Tool (1) according to claim 12, characterised in that the piston (2) is fixed in at least one rotary position (16) relative to the hydraulic cylinder (11) by means of a locking element (15).

14. Tool (1) according to claim 13, characterised in that the locking element (15) is a pin, sleeve or threaded stud.

15. Tool (1) according to claim 13, characterised in that the piston (2) has at least one receptacle opening or groove for the locking element (15).

16. Tool (1) according to claim 13, characterised in that the piston (2) can be fixed relative to the hydraulic cylinder (11) with the locking element (15) after setting the pulse rate.

17. Tool (1) according to claim 1, characterised in that the piston (2) can be rotated with an auxiliary tool to change the volume.

18. Tool (1) according to claim 1, characterised in that the piston (2) has an essentially L-shaped profile.

19. Tool (1) according to claim 1, characterised in that the piston (2) has two cylindrical internal diameters of different size.

20. Tool (1) according to claim 19, characterised in that at least one of the internal diameters of the piston (2) has a groove for an O-ring seal (13, 14).

21. Tool (1) according to claim 19, characterised in that at least one of the internal diameters of the piston (2) has a mounting surface for an O-ring seal (13, 14).

22. Tool (1) according to claim 1, characterised in that the reserve oil, the oil compensating volume and the increase in pulse frequency can be set simultaneously with the piston (2).

* * * * *